US011021289B2

(12) United States Patent
Stapfer

(10) Patent No.: US 11,021,289 B2
(45) Date of Patent: Jun. 1, 2021

(54) METHOD AND DEVICE FOR OPENING A RECEPTACLE

(71) Applicant: GIESECKE & DEVRIENT GMBH, München (DE)

(72) Inventor: Michael Stapfer, Neubiberg (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 458 days.

(21) Appl. No.: 15/124,212

(22) PCT Filed: Mar. 13, 2015

(86) PCT No.: PCT/EP2015/000572
§ 371 (c)(1),
(2) Date: Sep. 7, 2016

(87) PCT Pub. No.: WO2015/135662
PCT Pub. Date: Sep. 17, 2015

(65) Prior Publication Data

US 2017/0015456 A1 Jan. 19, 2017

(30) Foreign Application Priority Data

Mar. 13, 2014 (DE) ..... 102014003652.9

(51) Int. Cl.
*B65B 69/00* (2006.01)

(52) U.S. Cl.
CPC ..... *B65B 69/0033* (2013.01); *B65B 69/0008* (2013.01)

(58) Field of Classification Search
CPC . B65B 69/0033; B65B 69/0008; B08B 15/04; B23Q 11/0071; B26D 1/12
See application file for complete search history.

(56) References Cited

U.S. PATENT DOCUMENTS 4,696,615 A * 9/1987 Ettischer ..... B65B 69/0033 271/157
4,863,037 A 9/1989 Stevens et al.
(Continued)

FOREIGN PATENT DOCUMENTS

DE 3223387 A1 2/1983
DE 3443362 A1 5/1986
(Continued)

OTHER PUBLICATIONS

German Search Report from corresponding German Application No. DE 10 2014 003 652.9, dated Nov. 17, 2014.
(Continued)

*Primary Examiner* — Anna K Kinsaul
*Assistant Examiner* — Daniel Jeremy Leeds
(74) *Attorney, Agent, or Firm* — Workman Nydegger

(57) ABSTRACT

An apparatus for opening a receptacle for transporting value objects includes a suction device for suctioning the receptacle and a severing device for severing the receptacle in a suctioned region of the receptacle. The receptacle can be present in the form of a plastic bag in particular. A method for opening the receptacle then includes the steps of suctioning the receptacle by means of the suction device and of severing the receptacle in a suctioned region of the receptacle by means of the severing device.

17 Claims, 3 Drawing Sheets

(56) References Cited

U.S. PATENT DOCUMENTS 4,997,329 A * 3/1991 Hanamoto ..... B08B 9/083 414/412
5,054,620 A 10/1991 Dewitt et al.
5,054,700 A 10/1991 Dewitt
5,115,918 A 5/1992 Dewitt et al.
5,121,586 A * 6/1992 Focke ..... B65B 51/067 53/136.4
5,275,524 A * 1/1994 Ishiwata ..... B65B 69/0033 414/412
5,377,411 A * 1/1995 Andriotis ..... B26B 19/44 30/133
5,423,649 A * 6/1995 Maeda ..... B65B 69/0008 414/412
5,613,346 A * 3/1997 Yamamichi ..... B65B 69/0033 221/229
6,013,148 A * 1/2000 Bluemle ..... B65H 19/1852 156/159
D472,024 S * 3/2003 Caldwell ..... B26B 19/14 D32/32
D687,195 S * 7/2013 Sell ..... D32/21
2002/0162303 A1* 11/2002 Skrak ..... A22C 11/003 53/492
2003/0085534 A1* 5/2003 Bohn ..... B25F 3/00 279/143
2005/0000052 A1* 1/2005 Byles ..... A47L 9/02 15/314
2005/0082416 A1* 4/2005 Brenk ..... B65H 54/343 242/476.7
2005/0132575 A1* 6/2005 Chen ..... B26B 19/44 30/125
2006/0185484 A1* 8/2006 Sasaki ..... B23D 59/006 83/100
2007/0028447 A1* 2/2007 Ogawa ..... B26B 19/148 30/29.5
2007/0261195 A1* 11/2007 Bleicher ..... B08B 15/04 15/344
2009/0282787 A1* 11/2009 Pippin ..... B65B 69/0033 53/492
2009/0301031 A1* 12/2009 Jacobs ..... B65B 69/0033 53/381.2
2010/0170538 A1* 7/2010 Baker ..... B08B 15/04 134/18
2011/0008117 A1* 1/2011 Kasuya ..... B23Q 11/0046 408/67
2011/0266016 A1* 11/2011 Ohlendorf ..... B23Q 11/0046 173/198
2012/0090280 A1* 4/2012 Anatrini ..... B65B 69/0008 53/492
2012/0096819 A1* 4/2012 Piepereit ..... B65B 7/2842 53/510
2013/0192862 A1* 8/2013 Ceroll ..... B23Q 11/0046 173/198
2013/0337728 A1* 12/2013 Walker ..... B23Q 11/0071 451/453
2014/0020919 A1* 1/2014 Dvorak ..... B23Q 11/005 173/75
2014/0138114 A1* 5/2014 Takeuchi ..... B23Q 11/0046 173/198
2014/0298660 A1* 10/2014 Shelemey ..... B26B 19/34 30/133
2016/0016270 A1* 1/2016 Batres ..... B23D 59/006 83/100
2017/0158369 A1* 6/2017 Dopfer ..... B65B 69/0033

FOREIGN PATENT DOCUMENTS

DE 3902454 A1 8/1989
DE 3931176 A1 3/1991
DE 3781399 T2 12/1992
DE 102009053155 A1 5/2011
EP 0279857 B1 8/1992
EP 2119634 A2 11/2009
JP H02166034 A 6/1990

OTHER PUBLICATIONS

International Search Report from corresponding PCT Application No. PCT/EP2015/000572, dated May 20, 2015.
International Preliminary Report on Patentability from PCT Application No. PCT/EP2015/000572, dated Sep. 13, 2016.
Chinese Office Action from CN Application No. 201580011156.2, dated Dec. 18, 2017.

* cited by examiner

METHOD AND DEVICE FOR OPENING A RECEPTACLE

BACKGROUND

The present invention relates to a method and an apparatus for opening a receptacle adapted to transport value objects, for example to transport banknotes and the like.

Such receptacles are referred to as "safebags" and are usually configured in the form of completely sealable, bag-shaped disposable containers preferably made of a plastic foil. In such receptacles value objects, for example banknotes and other sheet-shaped documents of value, but also coins, are transported from a supplier or depositor to a bank or a cash center.

The opening of such a receptacle at a receiving unit is currently usually carried out manually, for example by means of a pair of scissors or a knife. After opening the receptacle the documents of value contained therein are removed and tested for example by means of a value-document processing apparatus (for example with regard to authenticity, condition and/or denomination).

A manual opening of such a receptacle by means of scissors or a knife is not only time-consuming, but always involves the risk that value documents disposed in the receptacle are damaged upon opening.

SUMMARY

Accordingly, it is the object of the present invention to suggest a method and an apparatus which takes account of the disadvantages described.

This object is achieved by an apparatus and a method having the features of the independent claims. Advantageous embodiments and developments are specified in the dependent claims.

A preferred embodiment of an apparatus for the at least partial opening of a receptacle for transporting value objects includes a suction device for suctioning the receptacle and a severing device for severing the receptacle suctioned by the suction device, in particular for severing the receptacle in a suctioned region of the receptacle. The suction device preferably includes a suction head and optionally a device for generating a negative pressure, i.e. a suction unit, and optionally a suction hose connected to the suction unit, connecting the suction head with the suction unit. The suction head includes one or several suction openings for suctioning the receptacle. The severing device usually includes at least one severing means for severing the receptacle, such as a blade for cutting open the container.

Preferably, the severing device performs the severing of the suctioned receptacle only in the suctioned region or between two or several suctioned regions of the receptacle, in particular only immediately next to the suction opening/the suction openings of the suction head. The severing device performs the severing of the receptacle preferably only in such regions of the receptacle which are removed by maximally 2 cm, particularly preferably by maximally 1 cm, from the suction openings. By severing only in the suctioned region or in the immediate vicinity of the suctioned region, damage to the receptacle content is avoided also in such cases in which the suctioned region of the receptacle can be lifted only little from the receptacle content by the suctioning, i.e. when the receptacle's material is relatively inelastic or tightly fitting or when the suction power is low.

The severing means is not disposed within a suction opening, for example, but is arranged in spatially separated fashion from the suction opening(s) in the surface of the suction head facing the receptacle to be severed. Preferably, the surface of the suction head facing the receptacle to be severed has at least two suction openings, wherein the severing means is preferably arranged between these suction openings. In comparison to a single (larger) suction opening in which the severing means is disposed, it is achieved thereby that less suction power is required, but the receptacle to be severed is nevertheless reliably suctioned in the region in which the severing means severs the receptacle.

As mentioned, such receptacles are provided for the safe transport of value objects and are usually configured in the in the form of plastic bags. The suction device is then adapted to suction at least a portion of a bag wall of the receptacle. The severing device is then particularly adapted to sever the bag wall in a suctioned region of the bag wall.

A preferred embodiment of a method for the at least partial opening of a receptacle, in particular a of bag-shaped plastic receptacle, includes the steps of suctioning the receptacle, in particular of suctioning a portion of a bag wall of a bag-shaped receptacle, by means of a suction device and of severing the receptacle in a suctioned region of the receptacle by means of a severing device.

When the receptacle is severed, said receptacle can be severed through corresponding relative movements between the severing device and the receptacle, e.g. along an L-shaped or U-shaped cutting line or along one or several cutting lines extending parallel to the side edges of the receptacle or along one or several diagonal cutting lines.

In this way, a corresponding receptacle for transporting value objects, in particular documents of value, can be opened quickly and easily. The severing device and the suction device are arranged so that the receptacle, i.e. in particular a receptacle wall of a bag-shaped receptacle, is suctioned by means of the suction device and the severing of the receptacle is effected in the suctioned region by means of the severing device. Due to the suction of the receptacle wall in the range of action of the severing device any damage to value documents upon opening can be avoided. In addition, the opening of the receptacle is facilitated per se. It is no longer required to make sure that the content of the receptacle is not damaged upon opening, since this will be prevented quasi automatically due to the operating principle of the apparatus.

Preferably, the severing device is integrated in the suction head, i.e. the apparatus includes a suction severing head. In this way it is achieved that in each case only that (relatively small) region of the receptacle needs to be suctioned in which the severing device is severing the same. Since the suctioned region—due to being suctioned—is not in contact with value documents in the receptacle, the value documents cannot be damaged by the severing device.

In particular, the severing device is mounted rotatably about a rotational axis in the suction head. The rotational axis of the severing device is oriented perpendicularly to the surface of the suction head (that faces the receptacle to be severed). The severing means, in particular the section of the severing means effective for severing the receptacle, is preferably arranged outside the rotational axis of the severing means, in particular outside the center of the severing device. It is thus achieved that, upon severing the receptacle, due to the friction force between the severing device and the receptacle, the severing means will rotate on its own to that side of the rotational axis in the direction of which the receptacle is moved relative to the severing device. In this way, the severing means will automatically orient itself with its longitudinal direction into the cutting direction, without an operator having to pay attention to this.

The severing means, in particular the blade, can protrude from the surface of the suction head (facing the receptacle to be severed), but it can also be flush with the surface of the suction head. To rule out any risk of injury caused by careless handling, the severing means can also be arranged in a depression, e.g. in a recess, present in the surface of the suction head, wherein there are also suction openings disposed in this depression. The receptacle to be severed is then suctioned into this recess and severed by the severing means.

As a safety measure, additionally or alternatively also a (for example annular) sleeve can be attached to the surface of the suction head around the severing means, into which sleeve the severing means can be retracted. The retraction of the sleeve (into a corresponding depression of the suction head) is effected, for example, against the force of a spring as soon as the suction head is pressed to the receptacle to be severed (or vice versa the receptacle to be severed to the suction head).

It can also be provided, however, that the severing device of the suction head needs to be pushed out from the suction head against the force of a spring to sever a receptacle. In a suction head to be used manually, the suction head can have e.g. a handle button with which the operator can push out the severing device from the suction head against the spring. Upon releasing the handle button, the severing device is pulled back into the suction head due to the spring force.

It can also be provided that the suction head to be used manually is placed in a quiver protecting the blade side when not in use. The quiver can be provided with a light barrier to detect the presence of the suction head. Through its presence in the quiver the suction head interrupts the switch to a suction pump. Upon removal from the quiver, the switch is automatically closed and turns on the suction pump. After the severing of the receptacle, the operator places the suction head back into the quiver, whereby the suction pump is turned off again.

Instead of the suction head to be used manually, however, also one or several suction heads can be integrated within a closed housing. In the housing, a conveying path for the receptacle to be severed can be present, along which a receptacle to be severed is conveyed through the housing by a succession of (for example elastic, rotating) pairs of rollers. The receptacle can, for example, be guided in the longitudinal direction along two suction heads permanently mounted between the roller pairs, so that the receptacle is cut open on one side on both opposing longitudinal edges. A third suction head can cut open the receptacle transversally to the transport direction (third cutting edge) when the transport is stopped for a short time. The turning on and off of the suction pump can again be triggered with the aid of light barriers which are attached along the conveying path and detect the receptacle. The cut-open receptacle and the contents leave the housing again. Since in this embodiment the operator has no access to the severing means, there is absolutely no risk of injury to the operator.

Further advantages of the method and apparatus result directly from the preferred embodiments described in the following.

According to a first preferred embodiment, the severing device is arranged in the apparatus so as to be stationary relative to a suction head of the suction device.

According to a second preferred embodiment, the severing device and the suction device of the apparatus can be adapted such that they are displaceable relative to each other. The suction device can include, for example, a suction head which extends along or over a portion of a bag wall of the receptacle for suctioning the receptacle, for example in the form of a frame or the like. The severing device can then be guided along the frame, i.e. along the suctioned region of the receptacle, for opening the receptacle. By means of this embodiment it can be optimally supported to open the receptacle along predetermined severing lines, for example.

As mentioned above, the severing device can include a severing means in the form of a cutting apparatus, for example a blade with at least one cutting edge. Alternatively, other mechanical severing means can be provided, severing means for the thermal severing of a plastic foil, severing means for laser cutting, or corresponding other suitable severing means.

The severing device having the severing means can be mounted rotatably, e.g. in the suction head. In this way the severing means can always be oriented suitably automatically in the direction contrary to that in which the severing means is guided along the receptacle, or in the direction in which the receptacle is guided along the severing means.

According to a first variant, the apparatus can be configured such that for opening the receptacle, the severing device is displaced relative to the receptacle manually or automatically. In other words, the receptacle remains substantially stationary during the opening, for example lying on a support, and the severing device is guided along the receptacle, which is opened thereby.

According to a second variant, the apparatus can be configured such that for opening the receptacle, the receptacle is displaced relative to the severing device. The severing device remains substantially stationary here. In other words, the receptacle is opened by guiding it along a fixed suction severing head of the apparatus, for example.

Generally the receptacle can be suctioned for opening such that the suctioned region of the receptacle is arranged only immediately in the region of the severing device. This will usually be the case when the apparatus includes a suction severing head described above. The receptacle is thus severed when the severing device is displaced relative to the receptacle and/or when the receptacle is displaced relative to the severing device.

Alternatively, the receptacle can also be suctioned in a region extending in oblong or areal fashion over a surface of the receptacle, for example when the suction head has a frame shape described above. The severing device can then be displaced for the severing of the receptacle within or along the suctioned region, whereby the receptacle is opened.

BRIEF DESCRIPTION OF THE DRAWINGS

The present invention will be described hereinafter by way of example with reference to the attached drawings. The figures are described as follows.

DETAILED DESCRIPTION OF VARIOUS EMBODIMENTS

Figure 1A:
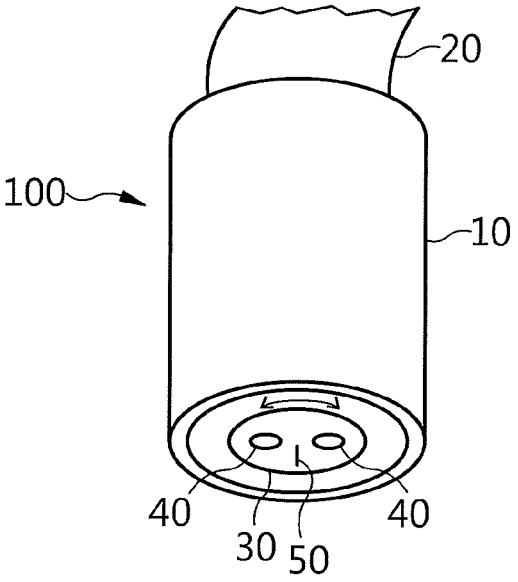
FIGS. 1 A and 1B a preferred embodiment of a suction severing head in a perspective view and in a sectioned view.
Figure 1B:
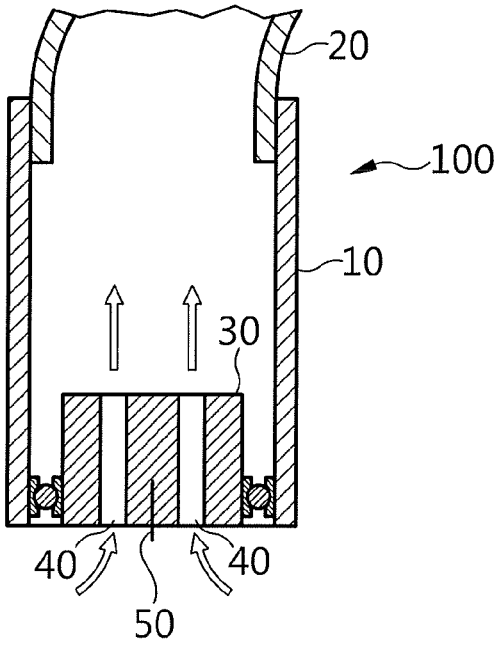

In FIGS. 1A and 1B, a suction severing head 100 is shown in a perspective view and in a sectional view. The suction severing head 100 can be utilized as an independent apparatus 100 for opening a receptacle of the type described below or as part of such an apparatus 100" as indicated in FIG. 3.

Figure 2:
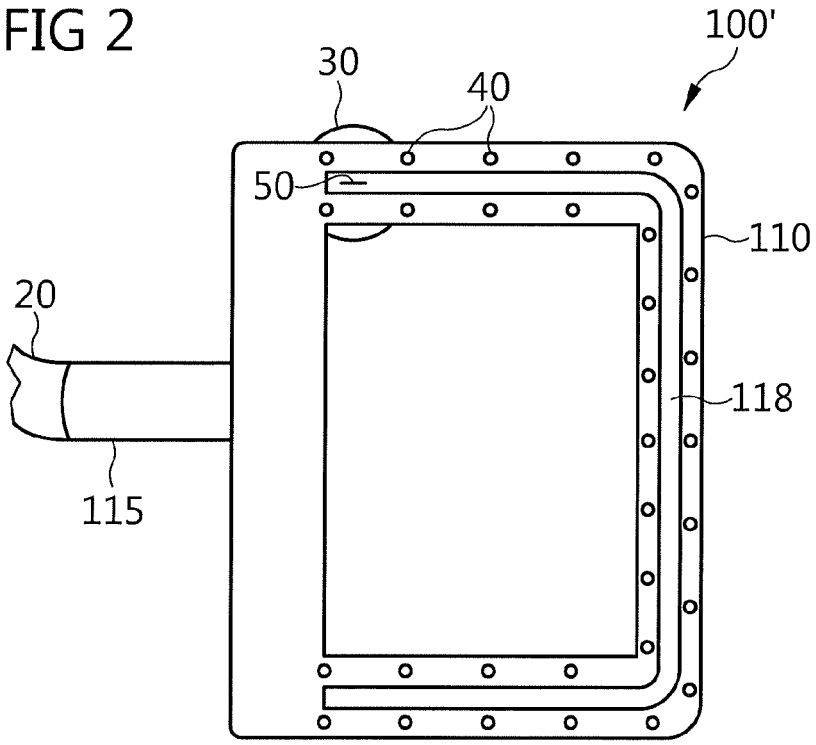
FIG. 2 an alternative preferred embodiment of an apparatus for opening a receptacle.
Figure 3:
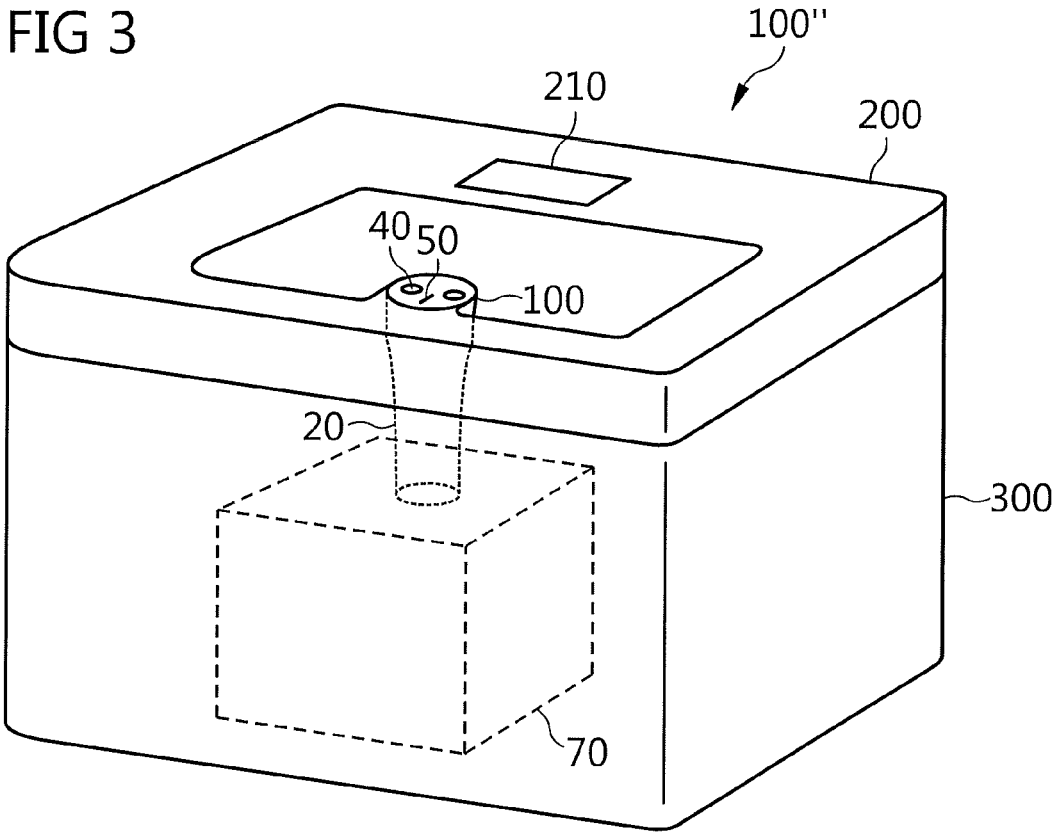
FIG. 3 a further preferred embodiment of an apparatus for opening a receptacle, and FIG. 4 steps of a preferred embodiment of a method for opening a receptacle.

Receptacles which can be opened by means of the apparatus shown in FIGS. 1 to 3 are receptacles that are provided for transporting value objects. Transported value objects herein are in particular sheet-shaped value documents such as banknotes. However, by means of the receptacles frequently also coins or the like are transported.

The receptacles, which are called "safebags" are usually present in the form of flat, bag-shaped receptacles. In a plan view of one of the two main surfaces, the receptacles are generally rectangular. Preferably, these receptacles are made of a plastic foil. The receptacles are completely sealed and have, for example, about the size of a large envelope, i.e. have side lengths of approximately 20 to 30 cm. Typically, instructions for cutting open the receptacle manually are printed on the receptacle. The receptacles can have one or several codings for unique identification, which can be read out by machine. Suitable codings are, for example, bar codes, transponders readable in contactless fashion or the like.

The suction severing head 100 of FIG. 1 includes a suction head 10 and is connected to a suction unit 70 (cf. FIG. 3) via an indicated suction hose 20. By such a suction unit 70 air can be suctioned through the suction openings 40 (as indicated by the arrows in FIG. 1B). In this way, the suction severing head 100, when it is brought close enough to a receptacle to be opened or when a bag to be opened is brought close enough to the suction severing head 100 (cf. FIG. 3), can suction a surface of the receptacle to be opened, in particular a bag wall of a plastic bag.

The severing device 30 integrally arranged with the suction head 10 includes a severing means 50 in the form of a blade. This severing means 50 serves to sever the receptacle in the suctioned region, i.e. cut it open in the example shown. For this purpose, on the one hand the suction severing head 100 can be displaced along the bag, for example when the suction severing head 100 is adapted as an independent, manually operable apparatus to open the receptacle. Alternatively, to open the receptacle, the receptacle can be guided along a stationary severing device 30, for example when the suction severing head 100 is integrated in an apparatus 100' according to FIG. 3.

The severing device 30 is mounted rotatably about a rotational axis in the suction severing head 100, as indicated in FIG. 1B. The severing means 50, in particular the section of the severing means 50 effective for severing the receptacle (thus the tip of the cutting edge), is preferably arranged outside the rotational axis of the severing device 30 (in FIG. 1A offset backward from the center of the severing device 30). It is thus achieved that, upon severing the receptacle, due to the friction force between the severing means 50 and the receptacle, the severing means 50 will rotate on its own to that side of the rotational axis in the direction of which the receptacle is moved relative to the severing device 30. In this way, the severing means (the blade) 50 will automatically orient itself with its longitudinal direction into the cutting direction, without an operator having to pay attention to this.

FIG. 2 shows an alternative embodiment of an apparatus 100' for opening a receptacle as described above. The apparatus 100' includes a frame-shaped suction head 110 with a plurality of suction openings 40. The suction openings 40 are distributed over a large portion of the frame, so that a receptacle can be suctioned in this portion. The frame shape can have substantially the dimensions of a surface of a receptacle to be opened. The suction head 110 can include a handle 115 to arrange the suction head 110 for opening the receptacle on the receptacle to be opened. The receptacle can lie flatly on a support herein, for example a table.

FIG. 2 shows the apparatus 100' in a top view of the side which rests on a surface of the receptacle upon opening the receptacle.

The frame-shaped suction head 110 can have a slot-shaped through opening 118 along which a severing means 50, for example in the form of a blade, can be guided by means of a knob-shaped severing device 30. Thereby, the suctioned receptacle can be opened along an L-shaped cutting line. It is understood that the shape of the frame of the suction head 110 can be configured as desired to define respectively suitable cutting lines. The severing device 30 can be connected to the suction head 110, but can also be present as a separate device.

Alternatively, the suction head 110 can be configured without the through opening 118. In this case, a suitable separate severing means, for example a knife, can be guided along the frame for opening the receptacle, while the receptacle is suctioned on a surface by the suction head 110.

FIG. 3 shows a further preferred embodiment of an apparatus 100" for opening a receptacle for transporting value documents. The apparatus 100" includes a plate-shaped support 200, in which a suction severing head 100 in accordance with FIG. 1 is integrated such that the suction openings 40 and the severing means 50 are arranged on the surface. For opening a receptacle, said receptacle now can be guided along the stationary suction severing head 100 in a fashion corresponding to the desired cutting lines.

The suction severing head 100 is connected via the suction hose 20 shown schematically to an also schematically indicated suction unit 70. The suction severing head 100 is integrated in a support of the apparatus, for example. The (for example plate-shaped) support 200 in the embodiment according to FIG. 3 rests on a rectangular cube 300 which includes the suction unit 70. The cube 300 can additionally be equipped for example with rollers or the like, so that the apparatus 100" can serve as a mobile unit.

According to an alternative embodiment, not shown, the support 200 can be present separately, i.e. without the cube 300. The support can then be arranged on a table or the like, for example. The support 200 does not need to be plate-shaped, but can also include several planar, oblique and/or curved surfaces.

The apparatus 100" in FIG. 3 (or the corresponding embodiment without the cube 300) can include additional devices which support a processing of the value documents removed from an opened receptacle.

An example of such a device is a reading device 210 adapted to read out a coding arranged on a receptacle to be opened. The reading means 210 can for example be configured as a bar code reader or the reader for reading out a transponder in contactless fashion.

Usually, the opening of such a receptacle is monitored for surveillance purposes by means of a camera (for example, the camera is integrated in the support 200 analogously to the reading device 210). A corresponding video recording can be started, for example, when the reading device 210 has read out a coding of a receptacle to be opened. When the emptying of a receptacle is completed, the video recording associated with this emptying process can be ended, for example as soon as the coding of the next receptacle is scanned. The value documents removed from the receptacle can then be processed by means of a suitable processing apparatus (not shown), for example checked for authenticity and counted.

The apparatus 100" can further include appropriate communication connectors (not shown), for example a USB or WLAN connector. This permits a data communication of the apparatus 100" with a control terminal (not shown) and/or the processing apparatus.

Optionally, the apparatus 100" can include a metal detector (for example integrated in the support 200 analogously to the reading device 210). The operator brings the receptacle, after its emptying, in the vicinity of the metal detector, to check for coins or the like. The metal detector can quickly and easily detect coins still present in an already opened receptacle. When coins are still disposed in a not yet inverted corner of the receptacle, this circumstance is pointed out to the operator by the metal detector, for example by an acoustic or optical signal. The receptacle does not need to be inverted at each of its corners by the operator then. By the metal detector the secure emptying of the receptacle is thus simplified and accelerated.

Figure 4:
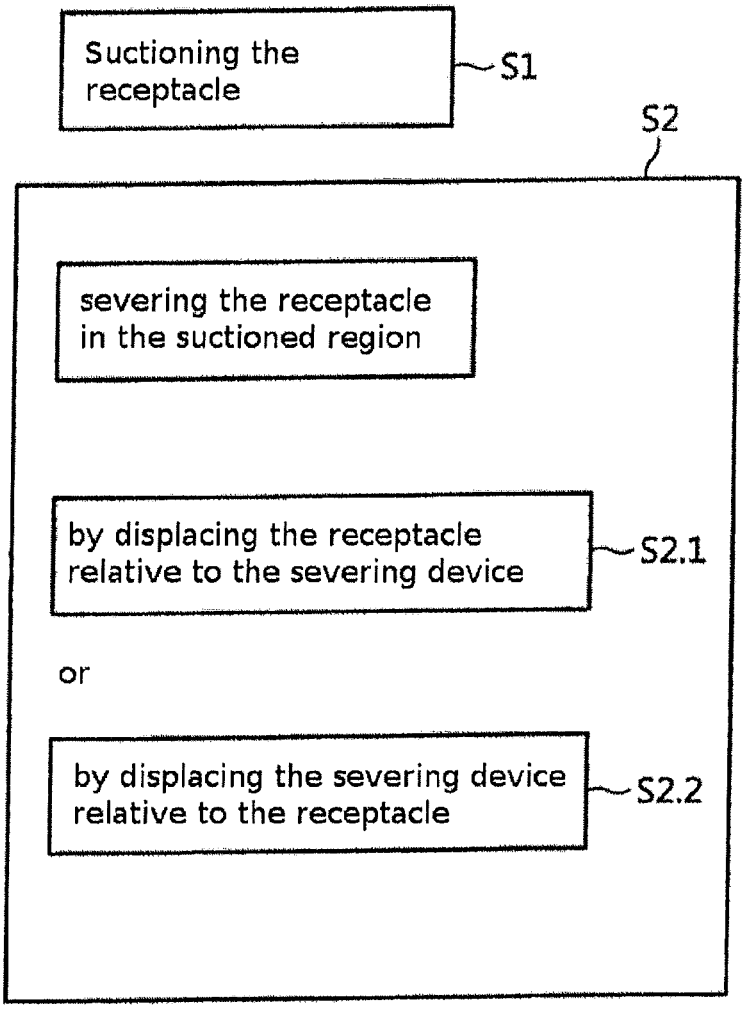

In FIG. 4 the substantial steps of a method for opening a receptacle are shown In step S1, the receptacle is suctioned with the suction head 10, 110. In step S2, the receptacle is severed in the suctioned region by means of the severing device 30. Here, either the receptacle can be guided along a stationary severing device 30 (step S2.1). Alternatively, the severing device can be displaced along the receptacle, wherein the receptacle does not need to be moved (step S2.2). Embodiments are conceivable in which both the receptacle and the severing device are displaced, i.e. moved, during the opening of the receptacle.

According to conventional opening methods, a rectangular, flat, bag-shaped receptacle is usually cut open along one or several side edges manually by means of a pair of scissors or a knife, and is then completely inverted. These methods are time-consuming and always involve the risk that value documents arranged in the receptacle are damaged upon opening.

An opening of the receptacle in the described manner of the invention offers numerous advantages in contrast.

On the one hand, a receptacle can be opened significantly faster and easier. According to a first variant, for example, the suction severing head 10 according to FIG. 1 can be guided as an independent apparatus over a surface of a receptacle to be opened along a freely selectable cutting line. The cutting line can be guided for example diagonally across one side or across both sides of the receptacle. Alternatively, the receptacle can be opened along an L-shaped cut along two side edges of the receptacle. Also a U-shaped cut is possible. All these ways of severing the receptacle can be performed without much effort. An inversion of the receptacle for removing the value documents disposed therein is facilitated considerably in contrast to the conventional methods.

A second and important advantage of the described method is that, upon opening the receptacle, the risk of damaging value documents disposed therein can be practically eliminated. This is because the receptacle wall is suctioned by the suction head 10, 110 and is thus kept away from value documents present in the receptacle while the receptacle is opened in the suctioned region.

The invention claimed is:

1. An apparatus for opening a receptacle for transporting value objects, comprising:

a suction device including a suction head defining at least two suction openings for suctioning the receptacle, a suction unit connected with the suction head, and a severing device for severing the receptacle in a suctioned portion of the receptacle, wherein the severing device is integrated in the suction head between the at least two suction openings and the suction head is movable relative to the suction unit, wherein the suction head is guidable over a surface of the receptacle along a freely selectable severing line for severing the receptacle.

2. The apparatus according to claim 1, wherein the suction device and the severing device are mutually arranged such that, when the receptacle is disposed at the suction device, a receptacle wall of the receptacle is suctioned by means of the suction device, and the severing of the receptacle is effected by means of the severing device in that region of the receptacle which is suctioned by the suction device.

3. The apparatus according to claim 1, wherein the severing device is arranged in stationary fashion relative to a suction head of the suction device.

4. The apparatus according to claim 1, wherein the severing device and the suction device are adapted such that they are displaceable relative to each other.

5. The apparatus according to claim 1, wherein the severing device includes a severing means in the form of a cutting apparatus.

6. The apparatus according to claim 1, wherein the severing device is mounted rotatably about a rotational axis, the rotational axis being perpendicular to a surface of the suction head that faces the receptacle;

wherein a section of the severing device effective for severing the receptacle is arranged outside the rotational axis of the severing device.

7. The apparatus according to claim 1, wherein the apparatus is adapted such that, for opening the receptacle, the receptacle is displaced relative to the severing device.

8. The apparatus according to claim 1, wherein the apparatus is adapted such that, for opening the receptacle, the severing device is displaced relative to the receptacle.

9. A method for opening a receptacle for transporting value objects, comprising the steps of:

suctioning the receptacle by means of a suction device, the suction device including a suction head defining at least two suction openings for suctioning the receptacle; and severing the receptacle in a suctioned portion of the receptacle by means of a severing device;

wherein the severing device is integrated in the suction head between the at least two suction openings, a surface of the suction head that faces the receptacle defining a severing plane; and wherein in the step of severing the receptacle, the suction head is moved relative to the receptacle in at least the severing plane, the receptacle remaining substantially stationary during the severing while the severing device is guided along the receptacle.

10. The method according to claim 9, wherein in the step of severing the receptacle, the suctioned portion of the receptacle is not contact with the value objects transported within the receptacle.

11. The method according to claim 9, wherein the receptacle is suctioned in such a fashion that the suctioned portion of the receptacle is suctioned in the region of the severing device, wherein, upon displacement of the severing device relative to the receptacle and/or upon displacement of the receptacle relative to the severing device, the receptacle is severed.

12. The method according to claim 9, wherein the receptacle is suctioned in a region extending over a surface of the receptacle, wherein the severing device is displaced within or along the suctioned region for severing the receptacle.

13. The method according to claim 9, wherein the receptacle is cut open in the step of severing.

14. The method according to claim 9, wherein in the step of severing the receptacle, the suction head is guided over a surface of the receptacle along a freely selectable severing line.

15. The method according to claim 9, wherein in the step of suctioning the receptacle, a receptacle wall of the receptacle is moved by means of a suction created by the suction device, and the severing of the receptacle is effected by means of the severing device in that region of the receptacle which is moved by the suction device.

16. The apparatus according to claim 2, wherein the suction device is configured such that, when the receptacle is disposed at the suction device, the receptacle wall of the receptacle is moved by means of a suction created by the suction device, and the severing of the receptacle is effected by means of the severing device in that region of the receptacle which is moved by the suction device.

17. The apparatus according to claim 1, wherein the severing device comprises a thermal severing means or a laser cutter.

* * * * *